United States Patent [19]

Richter

[11] 4,093,511

[45] June 6, 1978

[54] APPARATUS FOR OXYGEN BLEACHING OF PULP INCLUDING RECIRCULATION OF EXHAUST GASES

[75] Inventor: Johan Christoffer Fredrik Carl Richter, St. Jean Cap Ferrat, France

[73] Assignee: Kamyr Aktiebolag, Karlstad, Sweden

[21] Appl. No.: 656,585

[22] Filed: Feb. 9, 1976

Related U.S. Application Data

[62] Division of Ser. No. 500,899, Aug. 26, 1974, Pat. No. 3,963,561.

[30] Foreign Application Priority Data

Aug. 27, 1973 Sweden ..... 7311580

[51] Int. Cl.[2] ..... D21C 9/10; D21C 7/00

[52] U.S. Cl. ..... 162/234; 68/181 R; 162/237; 162/241; 162/248

[58] Field of Search ..... 162/65, 63, 241, 237, 162/239, 234, 246, 243, 67, 248, 238; 68/181 R; 23/290.5, 288 S; 261/112

[56] References Cited

U.S. PATENT DOCUMENTS

| | | | |
|---|---|---|---|
| 2,994,659 | 8/1961 | Slyngstad et al. | 23/288 S |
| 3,074,842 | 1/1963 | Strong | 162/237 |
| 3,138,947 | 6/1964 | Johnson | 162/237 |
| 3,174,313 | 3/1965 | Crosby et al. | 68/181 R |
| 3,298,900 | 1/1967 | Laakso | 162/237 |
| 3,550,356 | 12/1970 | Abboud | 261/112 X |
| 3,814,664 | 6/1974 | Carlsmith | 162/237 |

FOREIGN PATENT DOCUMENTS

| | | | |
|---|---|---|---|
| 81,032 | 5/1956 | Denmark | 162/243 |
| 209,964 | 1/1968 | U.S.S.R. | 162/43 |

OTHER PUBLICATIONS

Strom, "Improved Chlorination Control by Color Measurement"; Tappi, Nov. 1973, vol. 56, No. 11 162–238.

*Primary Examiner*—S. Leon Bashore
*Assistant Examiner*—Steve Alvo
*Attorney, Agent, or Firm*—Cushman, Darby & Cushman

[57] ABSTRACT

A method and apparatus for treating cooked fiber pulp as it comes from a continuous digester. The cooked pulp is bleached by intensively mixing the pulp with an oxygen containing gas, reacting the mixture while moving the mixed mass upwardly through a funnel shaped body within a pressurized reactor. The funnel shaped body is open at the upper end whereat the pulp mixture cascades over the side and flows downwardly into a ring chamber area between the reactor shell and funnel body, the pulp thereby forming a pressure barrier to any surplus gas within the reactor. The surplus unreacted gas is removed from the upper portion of the chamber for recycle with fresh pulp from the digestor and added gas. The treated pulp is removed from the lower portion of the ring chamber after passing downward therein.

4 Claims, 1 Drawing Figure

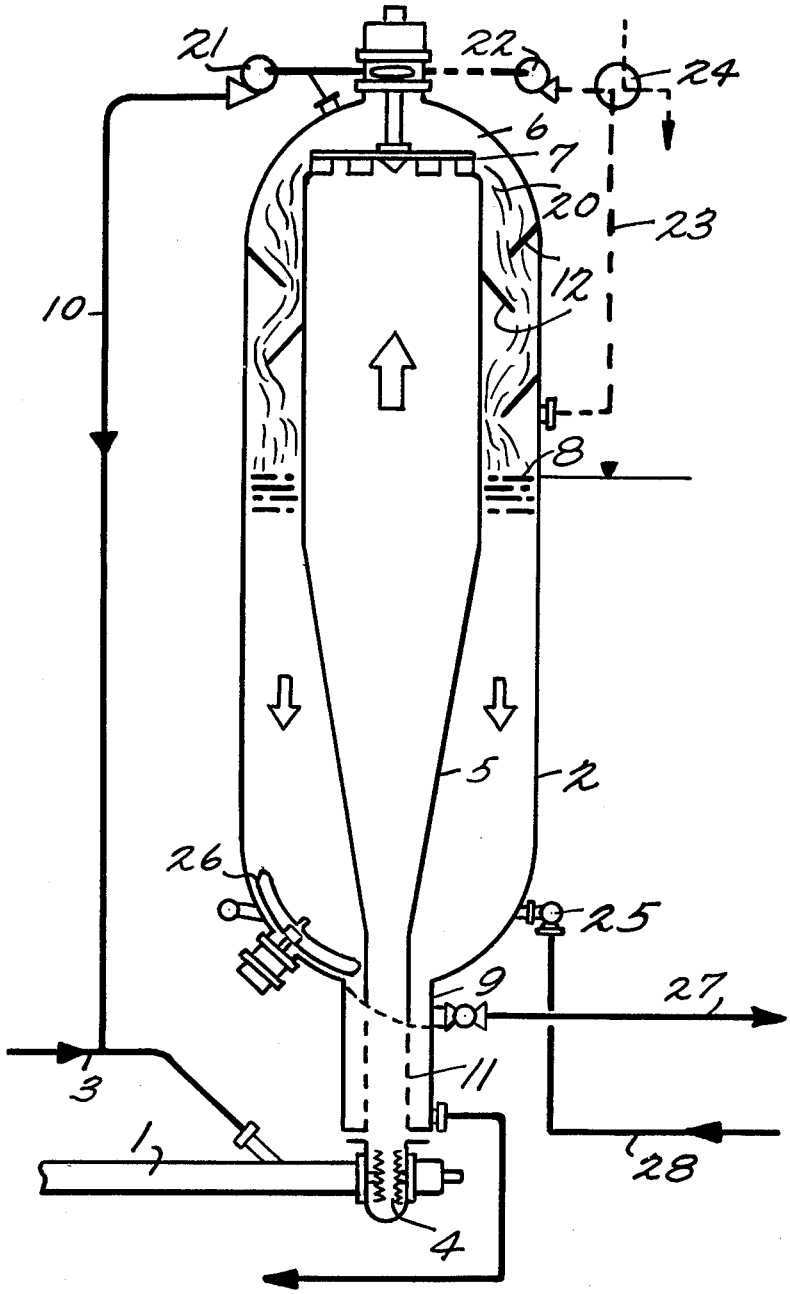
21
22
24
6
7
20
23
12
10
8
5
2
26
25
9
27
3
11
1
28
4

APPARATUS FOR OXYGEN BLEACHING OF PULP INCLUDING RECIRCULATION OF EXHAUST GASES

This is a division of application Ser. No. 500,899 filed Aug. 26, 1974, now U.S. Pat. No. 3,963,561.

BACKGROUND OF THE INVENTION

This invention is directed to a method and apparatus for treating fiber containing pulp, especially cellulose pulp, with an oxygen containing gas, in order to bleach the fiber containing pulp. The invention is expecially suited for treating cooked pulp directly passing from a continuous digestor. Gas suitable for the method according to the present invention may be either oxygen or an oxygen containing gas such as air.

Conventional methods are known wherein it is possible to remove lignin from cellulose pulp in order to obtain a greater degree of brightness of the pulp. Such conventional means involve treating the pulp by the use of oxygen gas or an oxygen containing gas in an alkaline medium employing increased temperature and pressure. It is also known that by use of certain protection substances, or so-called "protectors", it is possible to preserve the quality of the pulp which otherwise might be deturred due to the treatment. Prior to the present invention, installations for bleaching fiber pulp with an oxygen containing gas have required that the process be carried out in a container at an increased pressure, to which the fiber material, pulp, at a concentration generally from 20–30% in well shredded form has been fed into the top of a reactor, in which a temperature of 100°–140° C and a pressure of 1–12 atmospheres gauge has been maintained. Generally, the retention time of the pulp in such prior art reactors prior to dilution, mixing, and feeding from the reactor has been 30–60 minutes.

In a prior effort to improve the mixing and increase fiber surface area for reaction between the gas and fibers, a reactor has been designed with movable devices so that the pulp would fall stepwise from the top to the bottom of the reactor. In order to provide optimum contact in such a method between the pulp and the treatment gas, it has been necessary to maintain a relatively high concentration of the shredded pulp. In such methods, the shredded pulp forms a porous column containing the necessary quantity of reactive gas. However, when employing such high concentrations of the pulp, relatively little liquid is contained therein, and since the bleaching reaction process with oxygen, or oxygen containing gases, is exothermal, many difficulties have arisen when trying to control the reaction temperature with such known equipment. In an effort to overcome such problems, methods have been devised wherein certain quantities of the gas has been removed from the reactor, circulated through a cooling device and the cooled gas then re-introduced at a higher level into the reactor. However, it is difficult to achieve such a circulation in reactors having a large continuous pulp column wherein the gas is introduced therein.

Accordingly, it is the primary object of the present invention to provide a simplified procedure for bleaching cooked fiber pulp with oxygen containing gases.

It is also an object of the present invention to provide a suitable apparatus for bleaching cooked fiber pulp in a simplified manner.

It is a further object of the present invention to provide an apparatus arrangement which may be simultaneously utilized with the digestor pressure for direct feeding of the pulp into the reactor vessel, whereby commonly used apparatus may be eliminated from within the reactor.

It is a still further object of the present invention to provide a means and apparatus to recirculate reaction gas to the feed mixture thereby conserving the amount of gas necessary for said reaction.

SUMMARY OF THE INVENTION

The present invention provides a method for bleaching pulp, particularly cellulose pulp, with an oxygen containing gas to bleach the pulp as it comes directly from a continuous digestor. According to the procedure of the present invention, pulp is treated at a concentration of between about 5–20% i.e. as it comes directly from a continuous digestor. Preferably, the pulp concentration is about 8–12% In the process of the present invention, it is possible to simultaneously utilize the digestor pressure for direct feeding of a pulp into the reactor vessel, whereby commonly used apparatus such as thickners, high pressure presses, mixers, etc., as well as possible movable cascade devices in the side reactor may be eliminated. Methods and apparatus suitable for continuous digestion of lignin containing materials are well known as exemplified by U.S. Pat. Nos. 3,380,883, 3,041,232 and 3,200,032, the contents of each being incorporated herein by reference.

According to the present invention, by treating pulp at lower concentrations than normally employed heretofore in the art, one is able to more readily mix and finely distribute added gas throughout the pulp suspension. Furthermore, the lower the consistency of the pulp, the more slowly heat will be released during the process. It is possible to regulate the temperature of the pulp which is fed to the reactor of the present invention by employing the liquid of a suitable temperature from the preceding digestor, thereby obtaining desirable temperature conditions for the process in the reactor. By so regulating the temperature, one is able to control the pressure during treatment of the pulp.

Pulp is passed directly from a continuous digestor through a reactor partly in an upflow movement and partly in a downflow movement. A single reaction vessel can facilitate these movements. However, in addition to combining the two movements within one single vessel, one can obviously divide the upward and downward movements into two vessels wherein the first vessel operates as an upflow, and during treatment of the pulp the first vessel becomes completely filled with pulp. During the operation the pulp would move upward through said first vessel through a connection means at the top of the first vessel provided with means to transport the overflowing pulp to the top of a second downflow working vessel, wherein the pulp cascades to the lower portions thereof. In said vessel, pulp is removed from an outlet means at the lower end thereof. In the area above the level of pulp in the second downflow vessel, a gas chamber is located above the pulp.

For a better understanding of a process according to the present invention and apparatus used therein, reference is made to the drawing appended hereto, wherein a schematic diagram illustrating the apparatus (single vessel) of the present invention and the flow of pulp therein is set forth. The flow of pulp within the apparatus is indicated by the arrows.

After cooking pulp to a suitable Kappa-number, possibly washing and adding a suitable protector, such as NaOH (in a digestor), the pulp is fed through a pipe 1 to the bottom part of a substantially vertical standing reactor 2, while a gas (oxygen) is added through means for adding oxygen a piping 3. Additional necessary pipings and other auxiliary pipings for start-up of the bleach treatment are not illustrated herein. The pulp and gas are intensively mixed via a mixer 4 (e.g. defibrator type which comprises a means for emulsifying the pulp and oxygen), whereafter the pulp and gas emulsion formed therein flows upwards, in a centrally located (e.g. funnel shaped), central body or inner concentric sub-vessel 5. The central body 5 can have a driven device (not shown) for distribution and mixing of the pulp to the reactor top part which comprises a gas chamber 6. By so distributing and mixing the pulp during the reaction, the temperature is increased due to the exothermic nature of the treatment. The residence time of the pulp in the upflow portion of the reactor may be as long as 30 minutes, but preferably is up to about 20 minutes. About 90% of the pulp is oxidized in this manner within the central body 5, and then is fed over the top edge 20 of the funnel, for example, with a driven, preferably rotating, scrapping device 7. The almost completely oxidized pulp eventually falls under the action of one or more devices 12 through a ring-shaped gas filled outer chamber 6, located outside the central body 5 to a pulp level 8, whereafter the pulp moving with a certain downward velocity is completely oxidized after having consumed the residual oxygen. The baffles 12 comprise means for guiding the fall of pulp in the outer chamber 6 and for releasing gas trapped by the pulp falling in the outer chamber 6 from the pulp. The pulp is then removed from the bottom part 9 through the pipe 27 in a conventional manner, such as by action of one or more dilution devices 25 and/or possible stirring devices 26. The pulp located in downflow part from the level 8 to the outlet pipe 27 primarily serves as a lock barrier for the surplus gas at pressure above the level 8 of the pulp.

The scraper device 7 located in the horizontal plane may serve to a certain degree (in addition to its scraping function) to provide a throttling or braking action on the upflowing pulp. This is especially true since the pulp may have certain floatation tendencies. The scraper device is preferably designed as a plate with about the same diameter as the opened top part of the central body 5, and on the underside is provided with suitable scraper organs. It is also possible to employ a separate means for preventing floatation. Such means may be fastened to the container wall of the rotating "ceiling" over the central body 5 and may cover the desired area of the opening. Through the "ceiling" opening, a shaft of the rotating scraper may extend to an underlying scraper device of simpler design, for example a horizontal pipe to which the scraper organs are fastened. In either case, the floatation preventing part can be perforated to allow passage of surplus gas therethrough. Furthermore, such a floatation preventing means may be adjustable in height in order to regulate the throttling resistence. It is desirable that the speed of the scraper means be changeable, by means of a variable drive device in order that one may regulate the quantity of pulp which is scrapped out over the edge of a central body 5 at varying floatation of the pulp.

If desired, the driven scraper may be used for distribution of treatment gas and/or additional liquids, for example, sodium hydroxide. This is accomplished by elongating the vertical axis of the scraper downwards and providing within the shaft one or more lengthwise running hollow columns, of which one or more said hollow columns may be used for the addition of additional gas and/or liquid to the pulp by means of one or more distribution devices placed at certain levels in the central body 5 (this embodiment not illustrated). The addition of gas and/or liquid can, if desired, taken place in connection with the feeding initially of the pulp to the upflow portion of central body 5.

Oxygen containing gas which reacts with the pulp and is consumed within the reactor 2, is automatically replaced by means of suitable devices from the outside of the system through a pipe 3. However, the amount of gas fed at that point is generally insufficient to obtain the desired emulgation, needed for activating the oxidation process. Therefore, it is necessary to recirculate gas from the chamber 6 located in the top part of reactor 2 through a pipe 10 by means of a suitable fan, compressor, or an in-line ejector 21, to the pipe 3. The fan 21 and pipe 10 comprise means for exhausting gas from the top portion of chamber 6 and returning the exhausted gases to the pulp transporting means 1. Fresh oxygen containing gas may also be fed directly to the mixer 4, in such a fashion that the pulp/gas emulsion in the upflow part of central body 5 always contains a certain surplus of gas which is in unconsumed form. The gas is again given off to the chamber 6 and re-circulated to the central body 5. The floatation effect in the upflow portion of central body 5 may be controlled by means of circulating various quantities of gas, and the recirculation flow may be adapted to various pulp properties depending on consistency, fiber raw material, etc. The floatation can be additionally used to separate liquid from the fiber material to the extent desired and by extraction, for example through a screen 11 and pipe 28, in order to thereby thicken the pulp.

Should it be desirable to adjust the temperature in the gas chamber 6 of reactor 2, device 24 (for example, a fan) or compressor 22 in a pipe 23 may be used for lowering the temperature therein.

The invention in its broader aspects is not to be limited to the specific details shown and described, but departures may be made from such details within the scope of the accompanying claims without departing from the principles of the invention.

What is claimed is:

1. Apparatus for oxygen bleaching of pulp comprising an oxygen reactor vessel including an inner concentric sub-vessel having a larger diameter at the open top thereof than at the bottom thereof, and an outer chamber surrounding and completely enclosing said inner sub-vessel, said outer chamber having a pressurized gas-filled top portion thereof above the open top of said inner sub-vessel, and having a liquid level below the top of said inner sub-vessel, means for transporting high-consistency pulp to an inlet in the bottom of said sub-vessel, means for adding oxygen to said pulp in said means for transporting said pulp before entry into said opening in the bottom of said sub-vessel, means for emulsifying the pulp and the oxygen to thoroughly mix them together before entry of said pulp into the bottom inlet in said sub-vessel, rotatable scraper means associated with said inner sub-vessel at the top thereof to distribute pulp over the top edge of said inner sub-vessel into said outer chamber, an outlet for oxygen bleached pulp from said outer chamber, located adjacent the bottom of said outer chamber, and means for exhausting gas from said top portion of said outer chamber and returning said exhausted gases to said means for adding oxygen to said pulp in said means for transporting said pulp before entry into said opening in the bottom of said sub-vessel.

2. Apparatus as recited in claim 1 further comprising means for guiding the fall of pulp in said outer chamber and for releasing gas trapped by pulp falling in said outer chamber from said pulp, said means comprising a plurality of baffles disposed in said outer chamber above the level of liquid therein.

3. Apparatus as recited in claim 1 wherein said means for exhausting and returning gas from said top portion of said outer chamber to said means for adding oxygen comprises a fan disposed in a pipe connecting said top portion with said oxygen adding means.

4. Apparatus as recited in claim 1 wherein said emulsifying means comprises a defibrator.

* * * * *